United States Patent [19]

Spitaler

[11] Patent Number: 4,561,672

[45] Date of Patent: Dec. 31, 1985

[54] SAFETY SKI BINDING

[75] Inventor: Engelbert Spitaler, Wr. Neudorf, Austria

[73] Assignee: TMC Corporation, Baar, Switzerland

[21] Appl. No.: 555,043

[22] Filed: Nov. 23, 1983

[30] Foreign Application Priority Data

Nov. 24, 1982 [AT] Austria ..... 4268/82

[51] Int. Cl.[4] ..... A63C 9/08

[52] U.S. Cl. ..... 280/618; 280/629

[58] Field of Search ..... 280/613, 617, 618, 626, 280/629

[56] References Cited

U.S. PATENT DOCUMENTS

| | | | |
|---|---|---|---|
| 3,925,911 | 12/1975 | Erlebach | 280/618 X |
| 3,944,240 | 3/1976 | Bodendorfer | 280/613 |
| 4,000,567 | 1/1977 | Salomon | 280/613 X |
| 4,139,211 | 2/1979 | Salomon | 280/618 |
| 4,185,852 | 1/1980 | Himmetsberger et al. | 280/618 |

FOREIGN PATENT DOCUMENTS

| | | |
|---|---|---|
| 1951430 | 11/1975 | Fed. Rep. of Germany . |
| 2451757 | 10/1980 | France . |

*Primary Examiner*—Joseph F. Peters, Jr.
*Assistant Examiner*—Michael Mar
*Attorney, Agent, or Firm*—Flynn, Thiel, Boutell & Tanis

[57] ABSTRACT

A safety ski binding comprising a sole holder and comprising at least two holding jaws which hold the ski shoe in the downhill skiing position and which operatively engage a shoe fitting which is secured to a ski shoe in the region of the shoe sole. The holding jaws can be moved into a position which releases the ski shoe by means of a slide member which can be moved in longitudinal direction of the ski against the force of at least one recess spring. At least the shoe fitting or the holding jaws are provided with control surface structure which controls the release function. The shoe fitting, which is secured in the region of the sole of the shoe, is arranged within the sole dimension and preferably within the plane which is defined by the sole. The shoe fitting has two rear holding elements and at least one front holding element, which holding elements cooperate with two rear holding jaws and at least one front holding jaw. The front holding jaw includes structure supporting it for limited pivotal movement about a vertical axis which extends preferably as an extension of the axis of the tibia of the skier's leg.

11 Claims, 16 Drawing Figures

SAFETY SKI BINDING

FIELD OF THE INVENTION

The invention relates to a safety ski binding comprising a sole holder and comprising at least two holding jaws which hold the ski shoe in the downhill skiing position and which operatively engage a shoe fitting which is mounted on the bottom of the shoe sole, which holding jaws can be moved into a position which releases the ski shoe by means of a slide member which can be moved in longitudinal direction of the ski against the force of at least one spring, and wherein at least the shoe fitting or the holding jaws are provided with control surfaces which control a release.

BACKGROUND OF THE INVENTION

A safety ski binding of the above-mentioned type is described for example in German OS No. 19 51 430. In this conventional design, the sole plate is secured to the upper side of the ski. Two levers are swingably supported for movement out on the sole plate about axes which extend perpendicularly with respect to the upper side of the ski, which levers each carry one of the holding jaws which, in the downhill skiing position, grip around the shoe fitting which is secured on the ski shoe sole. Control ramps are provided on the levers, which ramps cooperate with control ramps on a power-transmitting member which can be moved in the direction of the tip of the ski against the force of a spring. During a release, the shoe fitting which is secured on the ski shoe swivels one or both levers, which effects or effect through the control ramps, a movement of the power-transmitting member against the force of the spring. The two holding jaws laterally engage the shoe fitting on the shoe sole. In order to avoid a looseness of the ski shoe in the binding, it is therefore necessary to additionally support the ski shoe on the ski in the region in front of the binding. This support is provided by a guide plate which is secured to the ski. However, during a release, the friction which occurs additionally between the ski shoe sole and the guide plate effects an increase of the release forces. Furthermore, the shoe fitting, which projects both laterally beyond the edges of the ski shoe sole and also downwardly beyond the remaining sole area, effects a high degree of discomfort during walking in the ski shoes, and also effects a clogging of the shoe fitting with dirt, snow and the like, as well as the risk of the shoe fitting getting caught on obstacles. A further disadvantage of this binding is that there is no precisely definable vertical axis capable of being associated with the ski shoe during a torsion release.

The purpose of the invention is now to provide a safety ski binding of the above-mentioned type such that it does not have the disadvantages of the conventional solution. Furthermore, a reliable hold of the ski shoe without its additional support is assured.

The set purpose is inventively attained by providing a shoe fitting which is secured to the ski in the region of the shoe sole and being arranged within the confines of the sole dimension and preferably within the plane defined by the sole. The sole fitting has two rear holding elements and at least one front holding element, which holding elements cooperate with two rear holding jaws and at least one front holding jaw, whereby the front holding jaw is supported for limited pivotal movement about a vertical axis which extends preferably coaxially of the tibia axis of the leg of the user.

Through the inventive measure, a safety ski binding with a sole plate is created, which assures a wobble-free hold of the ski shoe in the binding without necessitating an additional support of the ski shoe on the upper side of the ski. Therefore, a good centering and a reliable holding of the ski shoe in the holding jaw of the binding exists. Due to the fact that at least three holding elements are provided on the shoe fitting, the shoe fitting can be designed such that it does not project laterally beyond the shoe sole and also can be wholly housed accordingly within the confines of the shoe sole and in a recess therein. Furthermore, through a provision of a swingable support of the front holding jaw, there is provided a defined axis of rotation during a torsion release or a combined torsion and forward release.

A further characteristic of the invention consists in the two rear holding jaws being constructed as control hooks, which are arranged or secured on a control part, which control part is supported on the slide member, both of which can be simultaneously moved against the force of the release spring in a longitudinal direction of the ski. The control hooks are therefore coupled in a particularly simple manner with the slide member which is movable against the force of the release spring and can be moved against the force of the spring into their open position.

The front holding jaw is inventively constructed as a cup with preferably two holding zones for two front holding elements on the shoe fitting, which cup is supported for limited pivotal movement about the axis of a swivel pin which forms the vertical axis, which swivel pin is supported in the front area of a carriage which is supported for limited movement relative to a ski-fixed housing in the longitudinal direction of the ski. Also through this a particularly simple construction of the front holding jaw and a structurally simple swingable support of the same about the vertical axis is assured.

A further thought of the invention consists in the holding elements on the shoe fitting which cooperate with the control hooks or the holding zones of the cup, viewed in the sole plane, form the corner points of a rectangle and are constructed as rounded extensions of the shoe fitting, which extensions extend away from the ski shoe and in pairs from one another. With this a self-centering of the ski shoe during a stepping into the binding is assured.

A release of the ski shoe both during a torsional fall (that is, a fall wherein the human leg is subjected to a torsional stress) and also during a forward bending fall (that is, a fall wherein the human leg is subjected to a forward bending stress) is now inventively assured by the two control hooks having control surfaces thereon which control a torsion release and a forward bending release and the holding zones of the cup have the control surfaces thereon which control a rearward bending fall, which control surfaces are constructed on the upper region of the holding zones as inclined surfaces which extend in a direction toward the control hooks. In all of these fall directions or also during a combined fall direction, therefore, a movement of the control part with the control hooks against the force of the release springs is assured. The design of the control surfaces occurs, of course, in a manner such that during a torsion release there exists approximately ¼th of the release force of a forward bending release.

According to a further characteristic of the invention, the carriage which has the swivel pin mounted thereon is movably guided on a guideway on a base plate of the ski-fixed housing, whereby the control part is guided in a slotted hole in each of the side walls of the carriage by means of two peglike extensions. This structure provides a support of the control part on the carriage, which support assures, for the release of the ski shoe a movement of the control hooks relative to the carriage or to the cup, which cup is connected to the carriage through the swivel pin.

A further thought of the invention consists in the control part engaging with its surface area not facing the slide member a support nose preferably arranged on the guideway of the ski-fixed housing. This structure enables the ski shoe, even during a head-on collision of the ski with an obstacle, to be reliably released. In this case, namely, the ski shoe moves the front holding jaw, which is constructed as a cup, together with the carriage in a direction toward the tip of the ski, whereby through the control part which is maintained in a fixed position by the support nose, a compressing of the release springs occurs and the distance between the cup and the control hooks which are secured on the control part is enlarged so much that a release of the ski shoe is assured.

In order to move the binding into a position ready for the ski shoe to step thereinto, it is inventively provided that the control part can be supported by means of a locking surface on a locking step of the slide member, that the locking step on the slide member can be released, preferably by means of a release lever which is supported on the ski-fixed housing, from engagement with the locking surface on the control part, that the surface area of the control part facing the support nose is rounded concentrically with respect to the peglike extensions, and that on the underside of the control part there is connected one end of at least one tension spring, the other end of which is connected to a shoulder on the carriage. Therefore, as soon as the support of the control part on the slide member is cancelled, the tension springs swing the control part or the control hooks into the open position, and the binding is ready for the ski shoe to step thereinto.

A stepping into the binding inventively requires no renewed operation of the release lever since a control slope is provided on the control part above its locking surface, which slope slidingly cooperates with a leading slope provided below the locking step on the slide member.

For the elastic return of the swivel pin to its initial position, there is provided, according to a further characteristic of the invention, two elastic elements which are each active between the carriage and an abutment shoulder on the swivel pin.

A further advantage of the invention consists in a sole plate being secured to the carriage, which sole plate has a hole therein receiving a cylindrical hub on the swivel pin therein, which hub supports a cup thereon, and which sole plate is provided with recesses or notches which facilitate a longitudinal movement of the control hooks. A penetration of snow and dirt into the binding area is thus avoided and, therefore, the function of the binding is not influenced.

BRIEF DESCRIPTION OF THE DRAWINGS

Further characteristics, advantages and details of the invention will now be described in greater detail with reference to the drawings, which illustrate one exemplary embodiment.

In the drawings.

DETAILED DESCRIPTION

Figure 1:
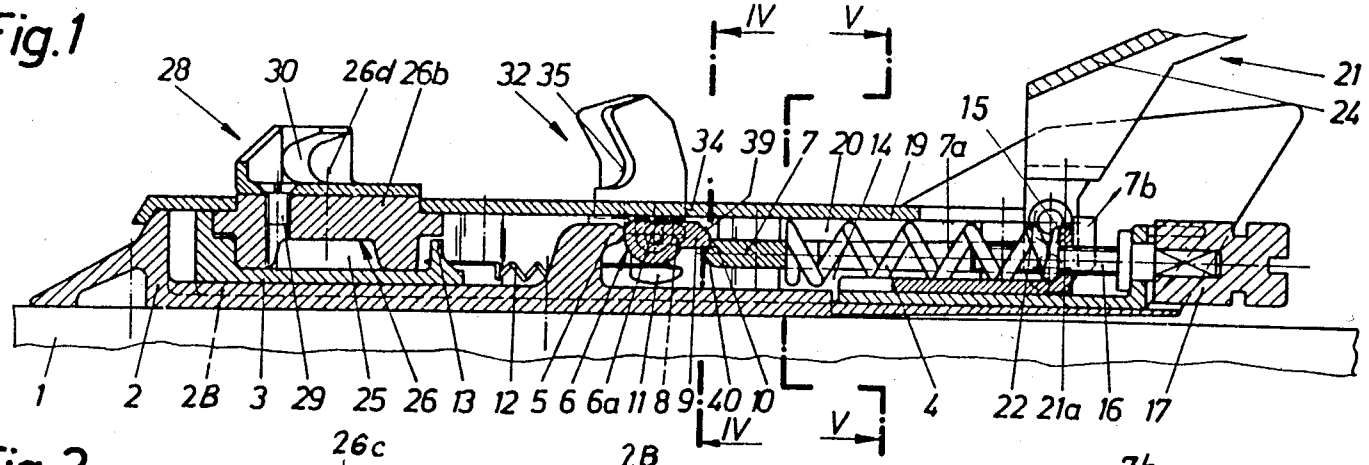
FIG. 1 is a central longitudinal cross-sectional view of the inventive safety ski binding in the downhill skiing position for holding a ski shoe therein.

The design of the safety ski binding is first described with reference to FIGS. 1 to 5. A housing 2 is secured to the upper surface of a ski 1 by means of screws 2A. The housing 2 consists substantially of a base plate, two side walls which extend vertically parallel with respect to the side edges of the ski and of a front boundary wall. Along the longitudinal axis of the base plate of the ski-fixed housing 2 there is constructed a guideway 2B for a carriage 3. The carriage 3 is movably supported on the guideway 2B of the ski-fixed housing 2 and is movable, limited in direction, toward the tip of the ski within the ski-fixed housing 2 against the force of release springs 4.

The carriage 3 has a troughlike shape. That is, it has two upstanding side walls which extend parallel with respect to the longitudinal axis of the ski, approximately midlength of each thereof there is provided an elongate slotted hole 8 which is elongated in a direction parallel to the longitudinal axis of the ski. Peglike extensions **6*a* of a control part 6 are each received in the slotted holes 8 of the carriage 3. The control part 6, which is arranged transversely with respect to the longitudinal axis of the ski within the side walls of the carriage 3 has a surface which is concentric with respect to the peglike extensions 6*a* on the part thereof which faces the tip of the ski and over its entire width as well as in the longitudinal cross section of the binding. The rounded surface area of the control part 6 extends also slightly beyond (rearwardly) of the underside of the control part 6. The surface area of the control part 6, which area faces the tail end of the ski, forms a locking surface 9 which extends laterally over the entire width of the control part 6 and which engages from above a locking step 10 on a slide member 7. A support nose 5 on the housing 2 is furthermore in engaging relation with the frontwardly facing rounded surface area on the control part 6. Specifically, the nose projects upwardly from the guideway 2B portion of the ski-fixed housing 2. Thus, the support nose 5 forms a ski-fixed structural part. The rearwardly facing surface area of the support nose 5, which rests on the control part 6, is also rounded. Furthermore, two downwardly projecting hooklike extensions 11 are provided on the underside of the control part 6 and are each arranged on the outer end regions of the control part 6. A pair of tension springs 12 are provided with one end of each thereof being attached to an associated one of the hooklike extensions. The two other ends of the springs 12 are each suspended or secured on an upwardly extending shoulder 13 which is provided on the carriage 3 and on a side of the support nose 5 remote from the control part 6. The control part 6 is thus pulled forwardly against the ski-fixed support nose 5 by means of the springs 12. Further, the springs 12 tend to urge the control part 6 for clockwise (FIG. 1**) movement about the axis of peglike extensions.

Figure 2:
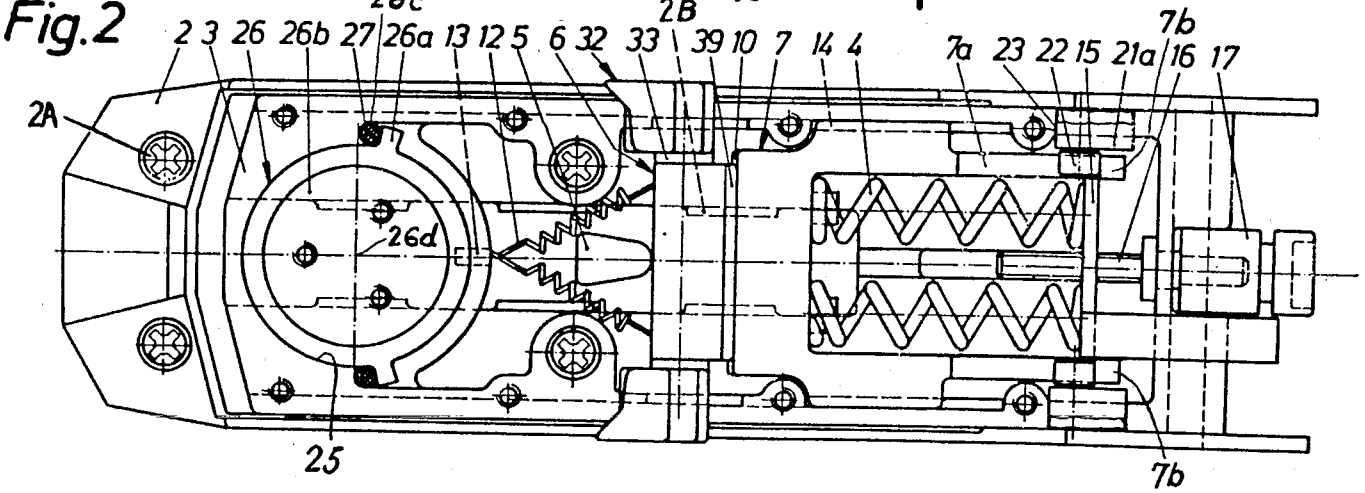
FIG. 2 is a top view of the safety ski binding, however, without the presence of the sole plate.
Figure 3:
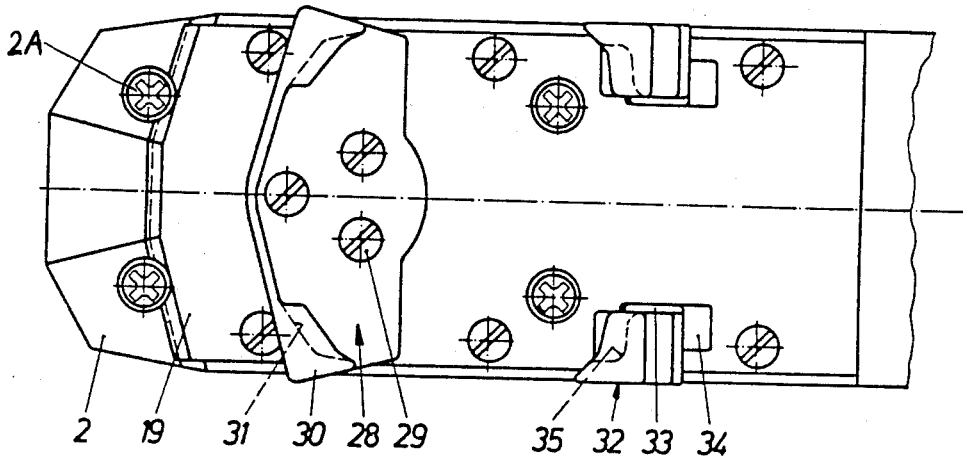
FIG. 3 is a top view of the front region of the safety ski binding with the sole plate thereon.
Figure 4:
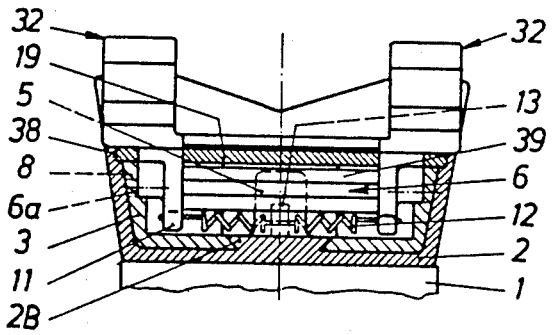
FIG. 4 is a cross-sectional view of the safety ski binding taken along the line IV—IV of FIG. 1.
Figure 5:
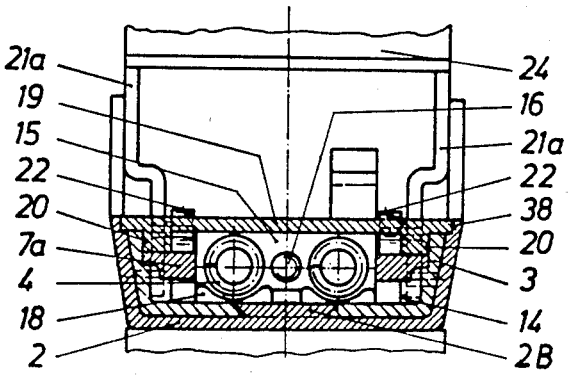
FIG. 5 is a cross-sectional view taken along the line V—V of FIG. 1.
Figure 11:
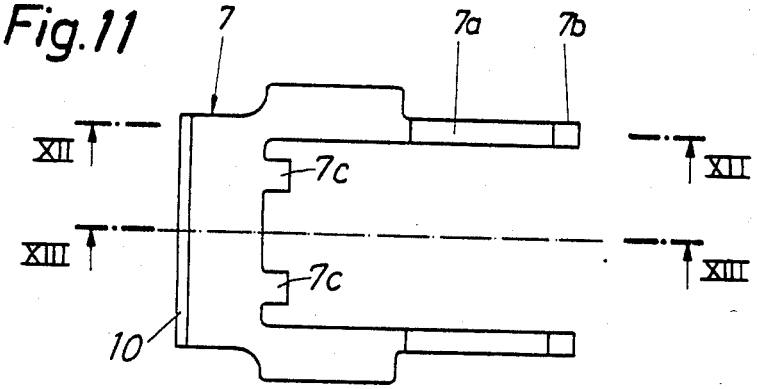
FIG. 11 is a top view of the slide member per se.

The slide member 7 has, viewed in the top view of FIGS. 2 and 11, a U-shape, whereby the crossbar part of the U constitutes the aforementioned locking step 10 and the two legs **7*a* each rest on guide shoulders 14 on the side walls of the carriage 3, which guide shoulders enable a movable guiding of the slide member 7 relative to the carriage 3 and in the longitudinal direction of the carriage. One end of each of the two release springs 4 is supported on the crossbar part of the U-shaped slide member 7, particularly on the tabs 7*c*. The other end of each release spring is supported on an abutment 15, which in a conventional manner is affixed to and movable with an adjusting screw 16 which extends through the rear boundary wall on the carriage 3 and has a slotted screwhead 17 on its outer end. By rotating the adjusting screw 16 by means of an operating tool which is inserted into the slot in the screwhead 17, it is possible to move the abutment lengthwise of the ski to thereby adjust the initial tension of the release springs 4 in a conventional manner. In order to secure the slide member 7 against a lifting off from the guide shoulders 14 of the carriage 3, guide shoulders 20 are provided on a sole plate 19 which is secured as by screws to the carriage 3. The shoulders 20 are provided on the underside of the sole plate 19 (see FIG. 5). As can furthermore be seen from FIG. 5, attachments 18 are provided on the bottom plate portion of the carriage 3, which attachments each have a recess for guiding and supporting the release springs 4**.

Figure 12:
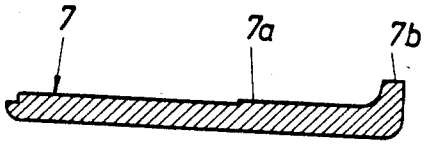
FIG. 12 is a sectional view taken along the line XII—XII of FIG. 11.
Figure 13:
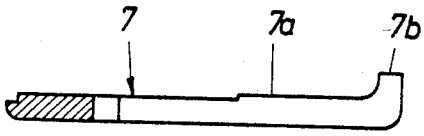
FIG. 13 is a sectional view taken along the line XIII—XIII of FIG. 11.

Adjacent the rear end portion of the carriage 3, particularly on its side walls, is swingably hinged a release lever 21 by means of two legs **21*a*. Above the hinge axis of the legs 21*a* of the release lever 21 there is secured on each leg 21*a* a pin 22 which extends inwardly in a direction toward the central longitudinal axis of the ski. The surface portion of each pin 22 facing the tail end of the ski rests on a holding arm 7*a*, which holding arms 7*a* are provided on the two legs of the slide member 7 and extend or project upwardly as at 7*b* (FIGS. 11 to 13) in a direction away from the upper side of the ski. To prevent an unintended swinging of the release lever 21 counterclockwise, stops 23 are provided on the side walls of the carriage 3. The two legs 21*a* of the release lever 21 are connected through an operating pedal 24. Upon applying a pressure onto the operating pedal 24, the pins 22 grip the upwardly extending arms 7*b* on the slide member 7 and move same in a direction toward the tail end of the ski, which causes the locking surface 9 on the control part 6 to become free from engagement with the locking step 10 on the slide member 7 to thereby effect a release of the ski shoe in a manner which will be described below. The amount of swinging movement of the release lever 21 is very small, since the necessary movement depends from the gripping overlap between the locking surface 9 and the locking step 10**, which gripping overlap can be kept very small.

A substantially vertically upstanding cylindrical receiving opening 25 for a cylindrical swivel pin 26 is provided in the front region of the carriage 3. The swivel pin 26 is supported for a slight pivotal movement relative to the carriage 3. For this purpose, two radially outwardly extending abutment shoulders **26*a* are provided on the swivel pin 26, by means of which shoulders 26*a* the swivel pin 26 is supported. Notches 26*c* are provided in the opening 25 and receive the shoulders 26*a* therein. Each shoulder 26*a* has between it and the associated notch 26*c* in the opening 25 in the carriage 3 an elastic element 27, which is for example an elastically deformable plastic part. The swivel pin 26 has a cylindrical hub part 26*b* which projects outwardly through a circular recess of the sole plate 19. Through this it is possible to secure a cup 28 on the swivel pin 26 by means of screws 29 (see FIG. 3). The side areas of the cup 28 are each provided with holding zones 30, which holding zones 30 each receive one end part of a holding element 37 on a shoe fitting 36 and are correspondingly formed so that the holding elements 37 of the shoe fitting 36 are secured both against a lateral disengagement and also against a vertical disengagement in the downhill skiing position. Furthermore, each holding zone 30 is provided, on the part thereof not facing the sole plate 19, with a control surface 31 which extends both at an angle with respect to the longitudinal axis of the ski and also at an angle with respect to the upper side of the sole plate. The function of this control surface 31** will be discussed below.

The movable control part 6, the position of which is determined by the position of the slide member 7, has on each of its two end regions adjacent the side edges of the ski 1, a bearing shoulder 33, which bearing shoulders 33 each project outwardly through recesses 34 of the sole plate 19. A control latch or hook 32 is fastened to each bearing shoulder 33 of the control part 6, for example by means of screws. Each control hook 32 is provided in its region facing the cup 28 with a control surface 35. The two laterally spaced control surfaces 35 cooperate with holding elements 37 of the shoe fitting 36 during both a torsion release due to a forward fall of the skier and also during a torsion release due to a fall to the side. Each control surface 35 is a three-dimensional control surface having a horizontal surface **35*a* and a vertical surface 35*b*, the vertical surface being sloped or inclined so that the bottom thereof is spaced further from the cup 28** than is the upper part thereof. The design is preferably such that, in the case of a torsion stress of the leg of the skier, the release force is reduced the necessary degree, approximately to ¼th of the release force of a forward bending release.

The fitting 36, which is secured to the ski shoe sole in a recess therein, is thus provided with four holding elements 37, of which the two front ones can be locked in the holding zones 30 of the cup 28 and the two rear ones in the control hooks 32. The design of the shoe fitting 36 can best be taken from FIGS. 6 and 7.

The sole plate 19 is secured as by screws, as already mentioned, to the carriage 3 and covers in each position of the binding the ski-fixed housing 2, so that a penetration of snow or dirt into the binding area is substantially avoided. The sole plate 19 which is connected to the carriage 3 can be moved together with the carriage 3 in longitudinal direction of the ski in a manner which will yet be described. For this purpose, guideways or tracks 38 for the sole plate 19 are provided on the upper end areas of the side walls of the ski-fixed housing 2 (see FIG. 4).

OPERATION

Figure 6:
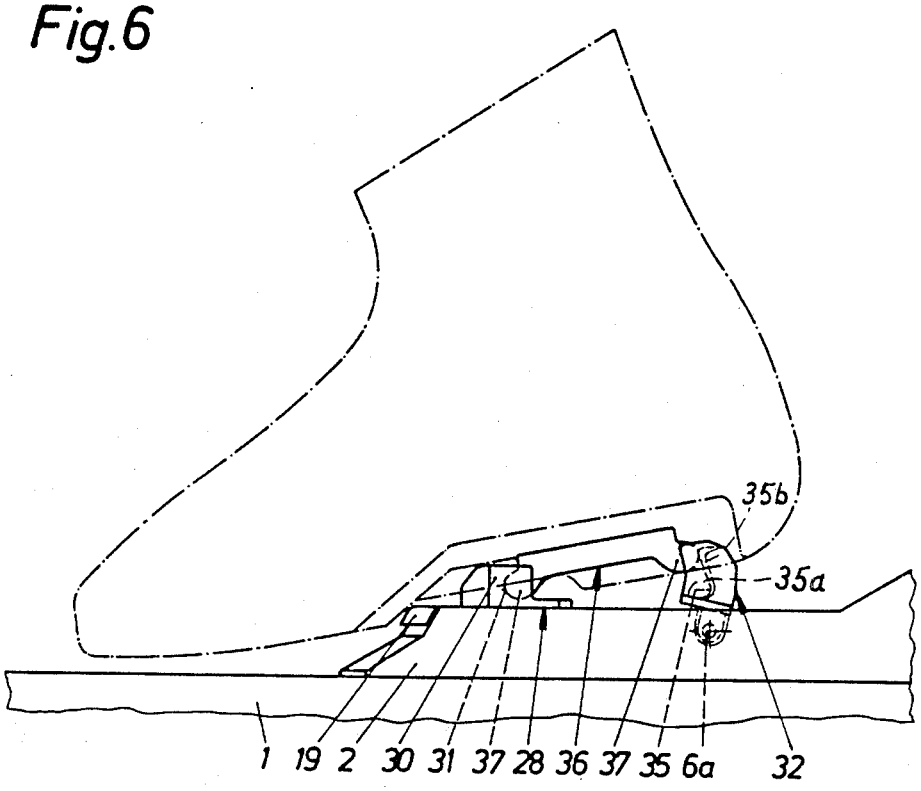
FIG. 6. is a side view of a position of the safety ski binding during a stepping-in procedure.

For stepping into the binding, starting out from the position illustrated in FIG. 1, the release lever 21 is swung through pressure applied to its operating pedal 24. Through this the two pins 22 move the slide member 7 against the force of the release springs 4 in a direction toward the tail end of the ski to eliminate or cancel the support for the locking surface 9 of the control part 6 on the locking step 10 of the slide member. For this, as has already been mentioned, only a slight swinging of the release lever 21 is needed. As soon as the control part 6 has been released from its support on the slide member 7, it swings or pivots about the axis of the peglike extensions, under the action of the two springs 12, in clockwise direction. The peglike extensions **6*a* are received in the slotted holes 8 of the carriage 3. This causes the control hooks 32 to also swing into their open position to render the binding ready for the ski shoe of the skier to step thereinto. During its swinging movement, the control part 6 slides by means of its circularly shaped rounded area along the ski-fixed support nose 5. For inserting the ski shoe into the binding, the two front holding elements 37 of the shoe fitting 36 are introduced into the cup 28 as shown in FIG. 6. The two rear holding elements 37 of the shoe fitting 36 load the horizontal control surfaces 35*a* of the two control hooks 32, which are presently swung into the open position. By pressing the ski shoe downwardly, the closed position of the binding is reached by the ski shoe effecting a swinging, through the control hooks 32, of the control part 6 counterclockwise (as in FIG. 1). A control slope 39 extending above the locking surface 9 on the control part 6, and which extends laterally with respect to the longitudinal axis of the ski, slidingly engages a leading slope 40 located below the locking step 10 of the slide member 7 and which also extends laterally with respect to the longitudinal direction of the ski, to cause the control part 6 to move the slide member 7 against the force of the release springs 4, until finally again the springs 12 can effectively cause the locking surface 9 to move counterclockwise (as in FIG. 1) and be supported once more on the locking step 10 of the slide member 7**. The ski shoe is now held clamped in the binding.

The release operation of the binding during a forward bending of the human leg (that is, forward fall) is as follows (see FIGS. 9 and 10): During the occurrence of a bending moment on the leg of a magnitude around the break-endangered point on the leg, the two rear holding elements 37 of the shoe fitting 36 load the vertical control surfaces **35*b* of the control hooks 32. The shoe fitting 36 of the ski shoe, which lifts off from the sole plate 19, thus slidingly moves the control part 6 and slide member 7 along with the control surfaces 35 of the two control hooks 32 rearwardly against the force of the release springs 4. The peglike extensions 6*a* of the control part 6 thereby slide in the slotted holes 8 of the carriage 3 in a direction toward the tail end of the ski. As soon as the holding elements 37 of the shoe fitting 36 have exceeded the upper end region of the vertical control surface 35*b*, a release of the ski shoe takes place, and the control hooks 32, control part 6 and slide member 7 are moved under the action of the release springs 4 again into their initial position. A renewed stepping into the binding occurs by operating the release lever 21** in the manner which has already been described above.

Figure 7:
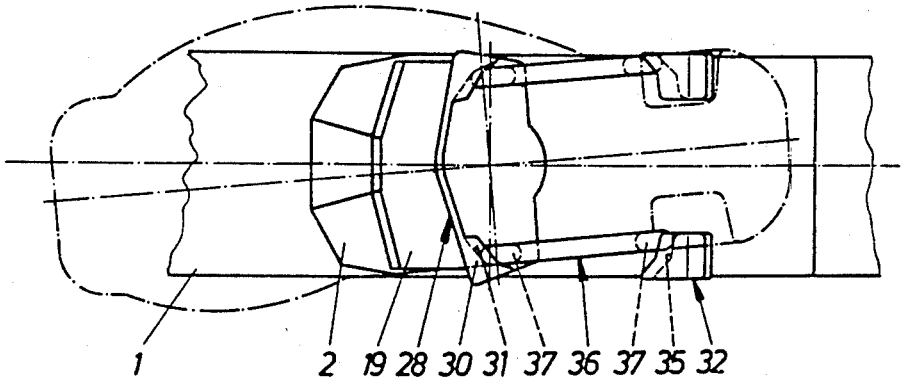
FIG. 7 is a top view of a position of the safety ski binding with inserted ski shoe during a torsion fall.
Figure 8:
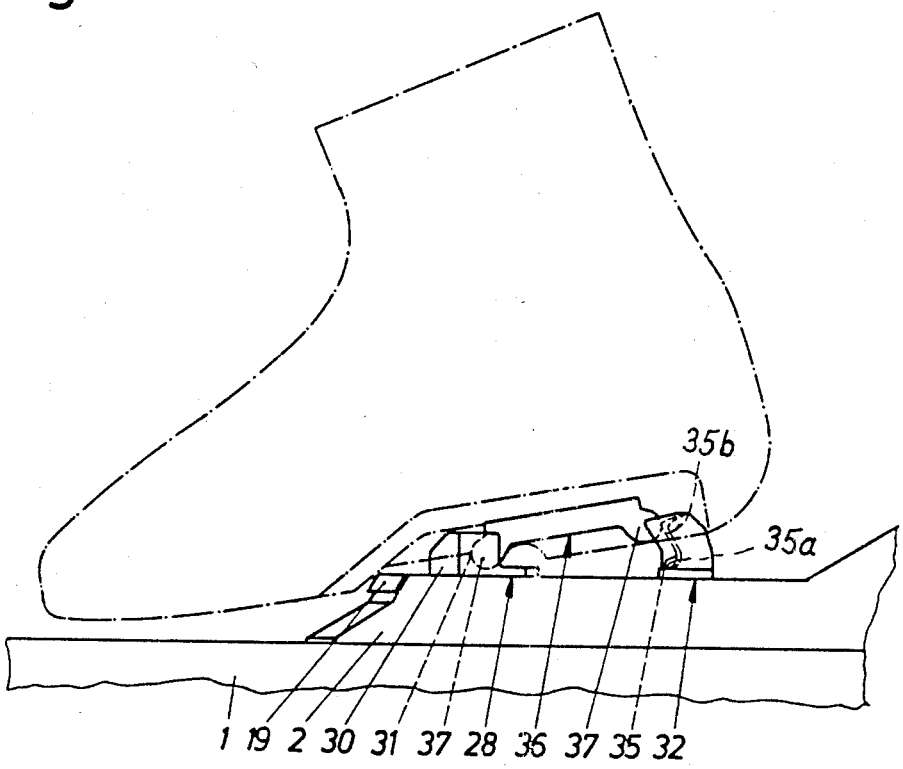
FIG. 8 is a side view of a position of the safety ski binding with inserted ski shoe during a twisting fall.

In the case of a torsion release (that is, a twisting fall), the fitting 36 secured on the ski shoe effects a slight pivoting of the cup 28 which is secured on the swivel pin 26, which pin is rotatable about a vertical axis **26*d* which extends approximately as an extension of the axis of the tibia of the human leg (see FIGS. 7 and 8). The pivoting movement of the swivel pin 26 occurs against the small compressive force offered by one of the elastic elements 27. During this pivoting movement, again the two rear holding elements 37 of the shoe fitting 36 load the vertical control surfaces 35*b* of the control hooks 32. Through this again the control part 6 which is supported on the locking step 10 of the slide member 7 moves the slide member 7 against the force of the release springs 4. The control surfaces 35 of the control hooks 32 are constructed such that during a torsion release both control surfaces become effective. As soon as the holding elements 37 of the shoe fitting 36 become free from the control surfaces 35 of the control hooks 32, there occurs the final release of the ski shoe. As long as the holding elements 37 of the shoe fitting 36 still cooperate with the control surfaces 35, a return of the ski shoe into the downhill skiing position is assured, provided the occurring forces are not sufficient to effect a release. Thus, through the form or shape of the control surfaces 35 a sufficient elasticity range exists for both the twisting or torsion moment and the forward bending moment. Following the release of the ski shoe due to a torsion release there occurs a return of the cup 28, caused by the return force of the elastic elements 27, and a return of the control hooks 32 and the control part 6 to their initial positions caused by the return force of the springs 4 acting thereon through the slide member 7**.

During the superposing of a forward bending moment and a torsion moment on the human leg, the two above-described sequences of movement take place simultaneously; the rear holding elements 37 of the shoe fitting 36 cooperating in the described manner with the control surfaces 35 of the control hooks 32.

During a rearward fall or rearward twisting fall, the two front holding elements 37 of the shoe fitting 36 cooperate with the control surfaces 31 of the holding zones 30 of the cup 28. Through the rearwardly tipping ski shoe, the front holding elements 37 slide along the control surfaces 31 of the cup 28, and through the inclination of the control surfaces 31 occurs a rearward movement of the ski shoe and thus of the shoe fitting 36, which causes the rear holding elements 37 of the shoe fitting 36 to load the control hooks 32 in the already described manner against the force of the release springs 4. As soon as the front holding elements 37 have become free from the control surfaces 31 of the holding zones 30 of the cup 28, there occurs the final release of the ski shoe. A sufficient elasticity range exists also in this case due to the form of the control surfaces 31, so that forces which are not sufficient for a release result in a return centering of the ski shoe.

Figure 9:
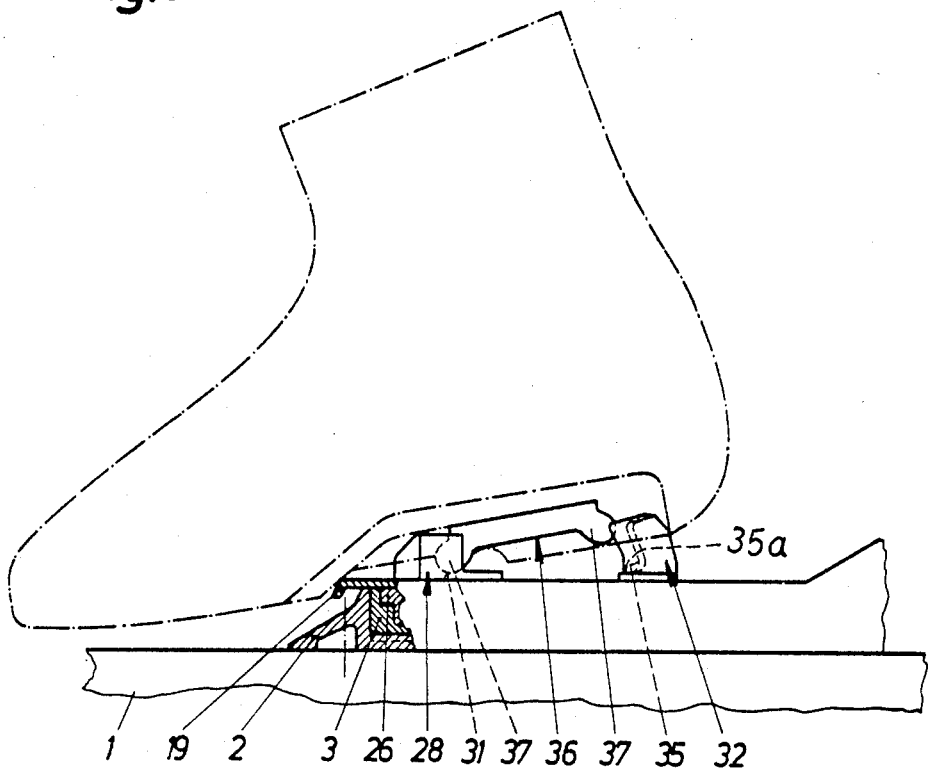
FIG. 9 illustrates a position of the safety ski binding with inserted ski shoe during a forward fall caused by skiing into an obstacle.
Figure 10:
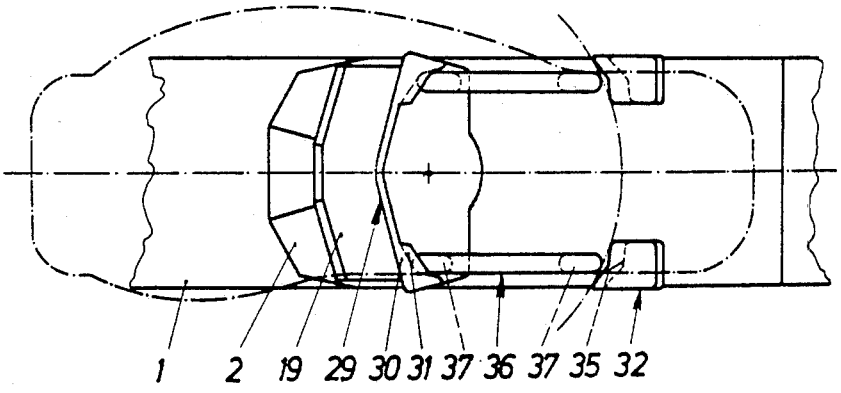
FIG. 10 is a top view of the holding elements and holding jaws in the position of FIG. 9.

During a movement of the ski head-on into an obstacle or, during skiing, through a depression, where also dangerously high forces can act onto the leg of the skier, the sole plate 19 moves together with the cup 28 and the carriage 3 in a direction toward the tip of the ski (i.e. to the FIG. 9 position). This movement occurs also against the force of the release springs 4, since the control part 6 is supported on the ski-fixed support nose 5 and because of this the control part 6, together with the slide member 7, does not change its position relative to the ski or to the ski-fixed housing. The release springs 4, which are supported through the abutment 15 on the carriage 3 are, however, compressed through the movement of the carriage 3. Through the movement of the sole plate 19 with the carriage 3, the distance between the cup 28 and the control hooks 32 is increased. The length dimension of the recesses 34 (FIG. 3) in the sole plate 19, into which recesses the bearing shoulders 33 of the control part 6 project, is chosen to facilitate an unhindered relative movement between the sole plate 19 and the control part 6. Due to the enlarging distance between the cup 28 and the control hook 32, a clamping of the shoe fitting 36 between these structural parts no longer exists. Since during skiing head-on into an obstacle also always generates one force component in the elevational direction or the lateral direction, a release of the ski shoe is assured.

Figure 14:
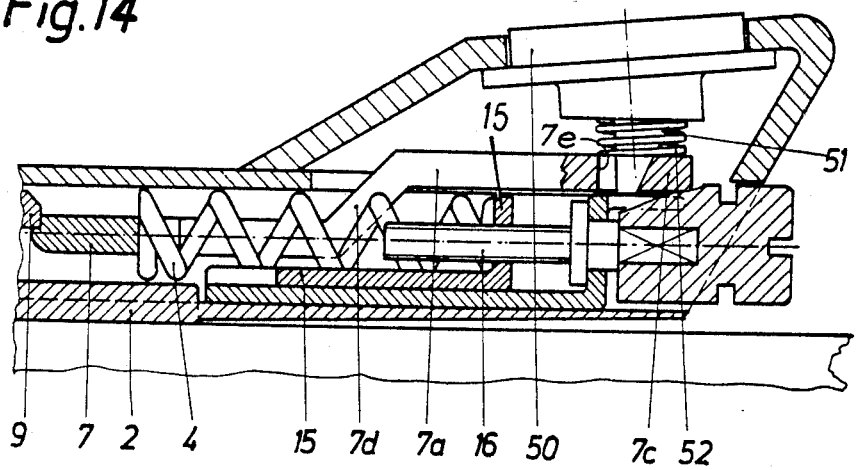
FIG. 14 is a modified voluntary release mechanism.
Figure 16:
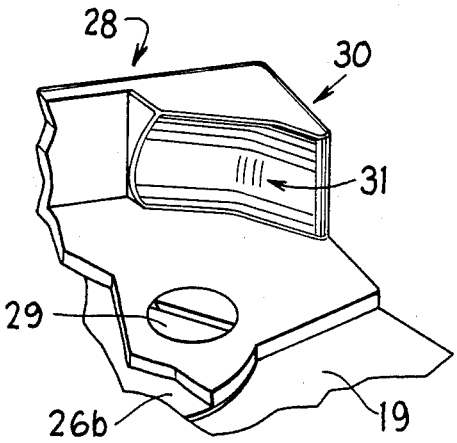
FIG. 16 is an enlarged perspective view of a holding zone on the front cup.
Figure 15:
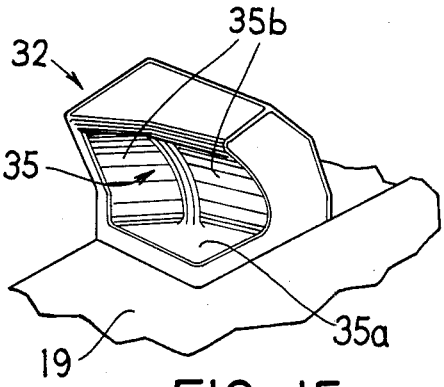
FIG. 15 is an enlarged perspective view of a control hook.

The invention is not to be limited to the illustrated exemplary embodiment. Further modifications are possible without departing from the scope of the invention. Thus it is particularly pointed out that the form of the control surfaces on the holding zones of the cup or on the control hooks are created or constructed in connection with the existing parameter, as, for example, the distance of the control surfaces from the vertical axis of the swivel pin, distance of the control surfaces from one another and the desired release characteristic and of the desired elasticity range. Furthermore, it is possible to use in place of the release lever a spring-loaded push button 50, as shown in FIG. 14, by means of which for example an operating shoulder of the abutment 15 for the release springs is loaded. That is, the push button 50 is depressed against the force of the spring 52 so that a wedge element 51 operatively cooperates with a hole **7*e* in the web part 7*f* adjoining the rear ends of the legs 7*a* of the slide member 7**. Also it is conceivable to provide the holding elements of the shoe fitting with a control surface which controls the release. Furthermore, it is by all means possible to arrange on the shoe fitting only one front holding element, which then cooperates with one single holding zone of the cup.

The embodiments of the invention in which an exclusive property or privilege is claimed are defined as follows:

1. In a safety ski binding comprising a sole holder having at least two rear holding jaws which hold a ski shoe in a downhill skiing position and which operatively engage a shoe fitting which is secured to said ski shoe in the region of a shoe sole, said holding jaws being movable into a position which releases said ski shoe by means of a slide member supported for movement in the longitudinal direction of a ski against the force of at least one spring, wherein at least said shoe fitting or said holding jaws are provided with control surface means which control a release, the improvement comprising wherein said shoe fitting is arranged within a plane defined by said sole of said ski shoe and has two rear holding elements and at least one front holding element, which holding elements cooperate with said two rear holding jaws and at least one front holding jaw, wherein said front holding jaw includes first means for supporting it for limited pivotal movement about a vertical axis which extends as an extension of the axis of the tibia of the skier's leg, said two rear holding jaws each being oriented on opposite sides of a central longitudinal axis of said ski with second means being provided for preventing both of said rear holding jaws from moving toward said central longitudinal axis.

2. The binding according to claim 1, wherein said two rear holding jaws are constructed as control hooks which are arranged on a control part supported on said slide member, wherein means are provided for supporting said two rear holding jaws for movement in the longitudinal direction of said ski against the force of said spring, said movement being together with said slide member.

3. The binding according to claim 2, wherein said front holding jaw is constructed as a cup with two holding zones adapted to receive two front holding elements of said shoe fitting therein, said first means supporting said cup for limited pivotal movement about a vertical axis of a swivel pin, said swivel pin being located in the front area of a carriage which is supported for limited movement in the longitudinal direction of the ski relative to a ski-fixed housing.

4. The binding according to claim 3, wherein said control surface means of said shoe fitting operatively cooperates with at least one of said control hooks and said holding zones of said cup, forms the corner points of a rectangle and are constructed as rounded extensions of said shoe fitting, which extensions extend away from said ski shoe and in pairs from one another.

5. The binding according to claim 2, wherein said two control hooks each have control surfaces which control a torsion release and a forward bending release and said holding zones of said cup have said control surfaces which control a rearward bending release, which surfaces are constructed in the upper area of said holding zones as sloped surfaces which extend in a direction toward said control hooks.

6. The binding according to claim 3, wherein said carriage has said swivel pin mounted thereon and is movably guided on a guideway on a base plate of said ski-fixed housing, wherein said control part is movably guided by means of two pinlike extensions each received in a slotted hole of the side walls of said carriage.

7. The binding according to claim 6, wherein said control part is supported by a surface area remote from said slide member on a support nose which is arranged on said guideway of said ski-fixed housing.

8. The binding according to claim 7, wherein said control part is supported by means of a locking surface on a locking step of said slide member, wherein said slide member is released by means of a release lever which is supported on said ski-fixed housing from engagement with a locking surface on said control part, wherein the surface area of said control part facing said support nose is rounded concentrically with respect to said pinlike extensions, and wherein on the underside of said control part there is suspended at least one tension spring, the other end of which is secured on a shoulder means on said carriage.

9. The binding according to claim 8, wherein a control slope is provided on said control part above its locking surface, which control slope slidingly cooperates with a leading slope which is provided below said locking step on said slide member.

10. The binding according to claim 3, wherein said swivel pin is returned into its initial position by means of two elastically compressible elements which are located between said carriage and an abutment shoulder of said swivel pin.

11. The binding according to claim 3, wherein a sole plate is secured to said carriage, which sole plate has a circular opening receiving a cylindrical hub on said swivel pin therein, which hub has said cup thereon, and which sole plate is provided with recesses which permit a longitudinal movement of said control hooks.

* * * * *